US005558677A

United States Patent [19]

Wagenmann et al.

[11] Patent Number: 5,558,677

[45] Date of Patent: Sep. 24, 1996

[54] DYEING AND PRINTING TEXTILE MATERIALS MADE OF CELLULOSE FIBERS

[75] Inventors: Henric Wagenmann, Heidelberg; Ulf Baus, Dossenheim; Eberhard Beckmann, Neustadt; Erich Kromm, Weisenheim, all of Germany

[73] Assignee: BASF Aktiengesellschaft, Ludwigshafen, Germany

[21] Appl. No.: 379,433

[22] PCT Filed: Sep. 8, 1993

[86] PCT No.: PCT/EP93/02424

§ 371 Date: Feb. 6, 1995

§ 102(e) Date: Feb. 6, 1995

[87] PCT Pub. No.: WO94/06961

PCT Pub. Date: Mar. 31, 1994

[30] Foreign Application Priority Data

Sep. 16, 1992 [DE] Germany ..... 42 30 870.4

[51] Int. Cl.[6] ..... D06P 1/22; D06P 1/651

[52] U.S. Cl. ..... 8/607; 8/611; 8/650; 8/652; 8/653; 8/918; 8/651

[58] Field of Search ..... 8/650–653, 607, 8/611, 918

[56] References Cited

U.S. PATENT DOCUMENTS 3,883,249 5/1975 Baumgarte et al. ..... 8/578
4,950,306 8/1990 Marte et al. ..... 8/607

FOREIGN PATENT DOCUMENTS 0364752 9/1989 European Pat. Off. .

*Primary Examiner*—Margaret Einsmann
*Attorney, Agent, or Firm*—Oblon, Spivak, McClelland, Maier, & Neustadt, P.C.

[57] ABSTRACT

A process for dyeing and printing textile materials consisting of cellulose fibers or containing cellulose fibers in a blend with other fibers in an aqueous medium at above pH 12 with vattable dyes in the presence of cyclic compounds which contain at least one instance of the structural unit (I)

in the ring of the molecule as reducing agents and finishing the dyeing in a conventional manner.

7 Claims, No Drawings

DYEING AND PRINTING TEXTILE MATERIALS MADE OF CELLULOSE FIBERS

The present invention relates to a process for dyeing and printing textile materials consisting of cellulose fibers or containing cellulose fibers in a blend with other fibers in an aqueous medium at above pH 12 with vattable dyes in the presence of at least one reducing agent for the vattable dyes and finishing the dyeing in a conventional manner.

EP-A-0 364 752 discloses a process for dyeing textile materials made of cellulose fibers with vat dyes in an alkaline medium, wherein the reducing agents used are mixtures of sodium dithionite and/or thiourea dioxide and α-hydroxycarbonyl compounds, such as hydroxyacetone, and the dyeing is carried out at a pH of not less than 13 and at temperatures above 75° C. The dyeing is then finished in a conventional manner by oxidizing and washing the dyed material. The α-hydroxycarbonyl compounds described therein, such as hydroxyacetone, are not sufficiently stable under the dyeing conditions, being converted in an unpredictable manner into a multiplicity of products which inter alia lead to odor problems. The use of sodium dithionite and/or thiourea dioxide as reducing agents in the dyeing of cellulose fibers with vat dyes causes sulfite and sulfate ion pollution in the production waste waters of dyehouses.

It is an object of the present invention to provide a reducing agent for the above-described process which is stable in the strongly alkaline dyeing liquor, i.e. which does not condense to form colored products under the dyeing conditions and ideally causes no odor problems.

We have found that this object is achieved by a process for dyeing and printing textile materials consisting of cellulose fibers or containing cellulose fibers in a blend with other fibers in an aqueous medium at above pH 12 with vattable dyes in the presence of at least one reducing agent for the vattable dyes and finishing the dyeing in a conventional manner, wherein the reducing agents used are cyclic compounds which contain at least one instance of the structural unit

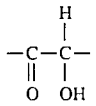

(I)

in the ring of the molecule.

Surprisingly, cyclic α-hydroxyketones that contain structure I give a higher color yield than hydroxyacetone. A further decisive advantage over hydroxyacetone is that the cyclic α-hydroxyketones that contain structure I in the ring of the molecule do not develop a troublesome odor in dyeing and, owing to their stability in the alkaline pH range, do not turn the liquor brown.

The textile materials consist of cellulose fibers or contain cellulose fibers in a blend with other fibers. They can be in any state of processing, for example in the form of loose fiber, card sliver, yarn on package, yarn as hank, woven fabric or knitted fabric. The cellulose fibers can be either natural or regenerated cellulose, such as staple viscose, filament viscose or polynosics. The process of the invention can be used for dyeing not only mercerized cotton but also raw cotton and also raw yarn on package or as hank. Synthetic fibers present in the textile materials in a blend with the cellulose fibers are for example polyester fibers, polyacrylonitrile fibers or synthetic polyamide fibers.

The cellulose fibers are dyed with vattable dyes, such as vat dyes, in particular indigo, or sulfur dyes. The vat dyes are either indigo or anthraquinonoid or indigoid dyes. Vat dyes and sulfur dyes have long been commercially available and are documented in the Colour Index (C.I.); cf. Colour Index, 3rd edition 1971, Volume 3, pages 3719 to 3844, and Volume 4, C.I. Nos. 58000 to 74000, Soc. Dyers and Colourists, England.

The vattable dyes are used in the process of the invention in the amounts hitherto customary for dyeing, for example within the range from 0.01 to 10% by weight, based on the textile material. It is possible to use a single dye or a mixture of two or more vattable dyes. The dyeing of the textile materials can take place by the exhaust method, for example from a long aqueous liquor at a liquor ratio of from 5:1 to 40:1, preferably from 8:1 to 20:1, or else in a continuous process, for example by the pad-steam process. In this case the liquor ratio used ranges from 0.5:1 to 3:1 and correspondingly higher concentrations of reducing agent and sodium hydroxide are used, usually from 10 to 100 g/l of at least one reducing agent and from 50 to 200 g/l of 38° Bé NaOH. Printing of the textile materials by the process of the invention is possible too.

The pH of the aqueous liquor is above 12. It is set by adding an alkali metal hydroxide to the aqueous dyeing medium. Suitable alkali metal hydroxides are sodium hydroxide and potassium hydroxide, the use of sodium hydroxide being preferred. The concentration of alkali metal hydroxide in the aqueous dyeing liquor is customarily in the range from 10 to 500, preferably from 30 to 250, ml of aqueous 38° Bé alkali metal hydroxide solution/l of liquor.

To dye cellulose fibers with vattable dyes, the dyes have to be converted into the leuco form. This is done using a reducing agent which according to the invention is a cyclic compound containing at least one instance of the structural unit

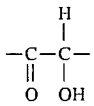

(I)

in the ring of the molecule. This kind of compound is essentially a carbocyclic compound having from 6 to 12, preferably from 6 to 8, carbon atoms in the ring, or a saturated α-hydroxycyclopentanone. The cyclic compounds having at least 6 carbon atoms in the ring may contain a double bond or a fused-on aromatic substituent. Examples of suitable compounds having the structural unit (I) in the ring of the molecule are the following compounds:

In the formulae I-XV the hydrogen atoms on the carbocyclic ring have for clarity been omitted.

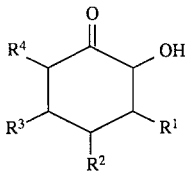

(II)

where the substituents $R^1$, $R^2$, $R^3$ and $R^4$ are independently of one another H, $C_1$–$C_4$-alkyl, OH, $OCH_3$ or phenyl, for example the compounds IIa to IId:

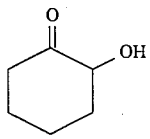

(IIa)

-continued (IIb)

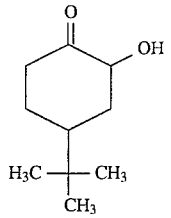

(IIc)

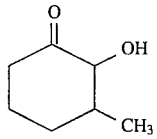

(IId)

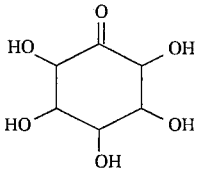

(III)

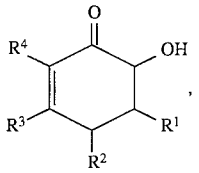

where the substituents $R^1$, $R^2$, $R^3$ and $R^4$ are each as defined in the formula II, for example the compounds IIIa–IIIc:

(IIIa)

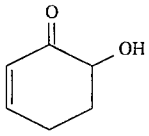

(IIIb)

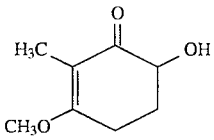

(IIIc)

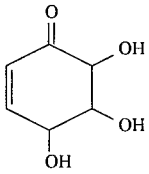

(IV)

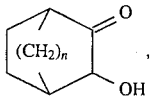

where n is 1 or 2, (V)

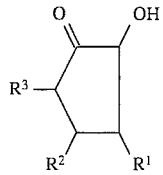

where the substituents $R^1$, $R^2$ and $R^3$ are independently of one another H, $C_1$–$C_4$-alkyl, OH, $OCH_3$ or phenyl, for example the compounds Va–Vc:

(Va)

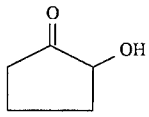

(Vb)

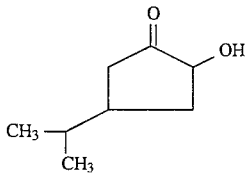

(Vc)

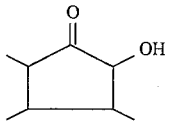

(VI)

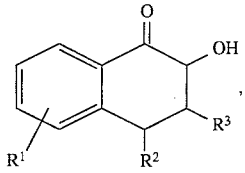

where the substituents $R^1$, $R^2$ and $R^3$ are independently of one another H, $C_1$–$C_4$-alkyl, OH or $OCH_3$, for example the compounds VIa–VIc:

(VIa)

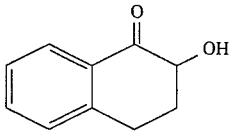

(VIb)

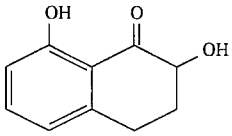

(VIc)

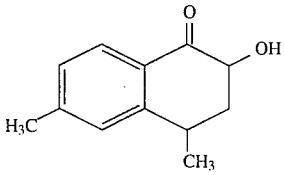

and also the compounds VII–XV:

(VII)

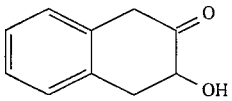

(VIII)

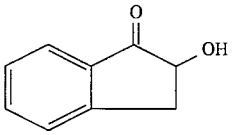

-continued (IX)

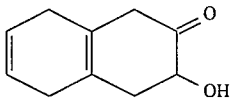

(X)

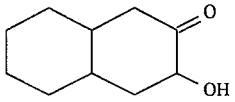

(XI)

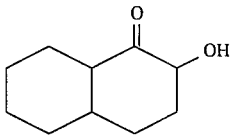

(XII)

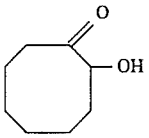

XIII

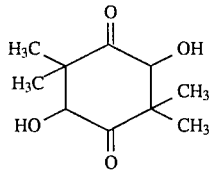

XIV

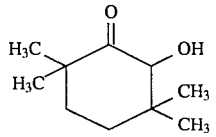

XV

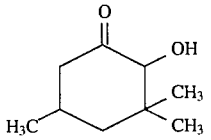

Of the above-indicated cyclic α-hydroxyketones containing the structural units I, α-hydroxycyclohexanone and α-hydroxycyclopentanone are preferred. Depending on the dye concentration in the dyebath, the cyclic α-hydroxyketones containing the structural unit I are used in amounts of from 0.5 to 10, preferably from 1 to 6, g/l.

To speed up the dyeing process, it has proven advantageous in some cases to carry out the dyeing or printing in the additional presence of quinonoid compounds which are water-soluble at above pH 12. Under the dyeing conditions these compounds are present in the aqueous liquor in a state of solution. Suitable quinonoid compounds for this purpose are known from DE-B-2 164 463. Quinonoid compounds are for example hydroxyl-, carboxyl- and/or sulfo-containing derivatives of benzoquinone, of naphthoquinone, of acenaphthenequinone or of anthraquinone, such as hydroxyanthraquinones, e.g. 2-hydroxyanthraquinone and 1,4-dihydroxyanthraquinone, anthraquinonecarboxylic acids and anthraquinonesulfonic acids, such as anthraquinone-2-sulfonic acid and 1,4-diaminoanthraquinone- 2-sulfonic acid. These compounds are customary for use as accelerants in vat dyeing. The quinonoid compounds are used in amounts of from 1 to 10% by weight, based on the amount of dye used.

The cyclic α-hydroxyketones that contain structure I can if desired be used together with any reducing agent known for the dyeing of vat dyes, for example in a mixture with sodium dithionite and/or thiourea dioxide. The weight ratio of cyclic α-hydroxyketones to be employed according to the invention to sodium dithionite and/or thiourea dioxide in such reducing agent mixtures is for example from 1:1 to 1:15, preferably from 1:2 to 1:10.

The alkaline aqueous dyeing liquor, in addition to at least one vattable dye and one or more cyclic α-hydroxyketones that contain structural units I, may contain polymers of monoethylenically unsaturated carboxylic acids as dyeing assistants. Such dyeing assistants are known for example from DE-B-2 444 823. They are essentially homo- and copolymers of monoethylenically unsaturated carboxylic acids. The copolymers contain at least 10% by weight of a monoethylenically unsaturated carboxylic acid in the form of copolymerized units. Individual compounds of this kind are for example polyacrylic acid, polymethacrylic acid, copolymers of acrylic acid or methacrylic acid with other monomers, for example methacrylamide, acrylamide, acrylonitrile, methacrylonitrile, acrylic esters or methacrylic esters. It is also possible to use copolymers of acrylic acid and maleic acid, copolymers of acrylic acid and itaconic acid, copolymers of maleic acid and vinyl esters, copolymers of maleic acid and vinyl ethers. The only essential requirement is that the copolymers should contain at least 10, preferably at least 50, mol % of a monoethylenically unsaturated carboxylic acid in the form of copolymerized units. The copolymers can be used as dyeing assistants in the form of the free acids or preferably already neutralized with alkalis. The K values of the homo- and copolymers of monoethylenically unsaturated carboxylic acids range from 15 to 90, preferably from 20 to 65. The K values are determined by the method of H. Fikentscher, Cellulosechemie 13 (1932), 58–64, 71–74, on a 1% strength by weight aqueous solution of the sodium salt at 25° C. and pH 7. The polymers are used in amounts of from 0.05 to 2% by weight, based on the textile materials to be dyed.

The dyeing is carried out within the temperature range within which it is customary to carry out vat dyeings using reducing agents, for example within the range from 20° to 130° C., preferably from 40° to 115° C. If temperatures above the boiling point of the liquor are employed, the dyeing is carried out in conventional pressure apparatus such as HT apparatus, jet dyeing machines, etc. in accordance with the makeup form of the textile material.

The textile material, which following the treatment in the dyebath contains the vatted dye in the leuco form, is treated in a conventional manner to finish the dyeing. To this end the textile material is first oxidized in a conventional manner of vat dyeing, for example by exposing the leucodye-containing material to the air or treating the material with an aqueous liquor which contains hydrogen peroxide or some other oxidizing agent. After oxidation the dyed textile material is rinsed and soaped. However, the dyeing can also be finished by first rinsing the textile material which contains the vat dye in the leuco form, then oxidizing and then soaping. Soaping is customarily effected using an aqueous solution of a wetting agent with or without sodium carbonate. The dyeings obtained are rub- and wash-fast, and the dyehouse waste water is not contaminated with sulfate or sulfite ions.

EXAMPLES

Example 1

A bleached cotton tricot is dyed in a laboratory beaker bath in a liquor ratio of 20:1 with a liquor containing per liter 0.5 g of the blue vat dye of C.I. No. 69825, 30 ml of 38° B é sodium hydroxide solution and 3 g of α-hydroxycyclohexanone. The dyeing vessel is introduced into the bath at 25° C. and heated over 15 min to 60° C. The cotton tricot is then dyed at 60° C. for 30 min. It is then removed from the dyebath and finished in a conventional manner by oxidizing, rinsing and soaping. The blue dyeing obtained is level and rub- and wash-fast.

Example 2

A bleached cotton tricot is dyed in a laboratory beaker bath in a liquor ratio of 20:1 with a liquor containing per liter 0.5 g of the green vat dye of C.I. No. 59825, 30 ml of 38° Bé sodium hydroxide solution and 3 g of α-hydroxycyclohexanone. The dyeing vessel is introduced into the bath at 25° C. and heated over 15 min to 60° C. as described in Example 1. The dyeing of the textile material is carried out at 60° C. over 30 min. The cotton tricot is then removed from the dyebath and finished in a conventional manner by oxidizing, rinsing and soaping. The green dyeing obtained is level and rub- and washfast. Its depth of shade corresponds to that of a comparative dyeing obtained by the known IN method by dyeing the same material with a dyeing liquor containing per liter 18 ml of 38° Bé sodium hydroxide solution and 6 g of sodium dithionite at 60° C. for 45 min.

Comparative Example 1

A bleached cotton tricot is dyed in a laboratory beaker bath in a liquor ratio of 20:1 with the dyeing liquor containing per liter 0.5 g of the blue vat dye of C.I. No. 69825, 30 ml of 38° Bé sodium hydroxide solution and 3 g of hydroxyacetone. The dyeing was carried out under the conditions specified in Example 1. The result obtained was a level, rub- and wash-fast blue dyeing which was about 40% weaker than that obtained in Example 1.

Comparative Example 2

Example 2 was repeated replacing the α-hydroxycyclohexanone reducing agent with 3 g of hydroxyacetone/l of liquor. The result obtained was a level, rub- and washfast green dyeing which was about 50% weaker than that obtained in Example 2.

Example 3

A bleached cotton tricot is dyed in a laboratory beaker bath in a liquor ratio of 20:1 with a liquor containing per liter 0.5 g of the blue vat dye of C.I. No. 60015 (Vat Blue 26), 30 ml of 38° Bé sodium hydroxide solution and 3 g of α-hydroxycyclopentanone. The dyeing vessel is introduced into the bath at 25° C. and heated over 15 min to 60° C. The cotton tricot is then dyed at 60° C. for 30 min. The dyeing is then finished in a conventional manner by oxidizing, rinsing and soaping. The blue dyeing obtained is level and rub- and wash-fast. Its depth of shade corresponds to that of a comparative dyeing obtained with a liquor containing per liter 18 ml of 38° Bé NaOH and 6 g of sodium dithionite.

Comparative Example 3

Example 3 is repeated with a dyeing liquor containing per liter 0.5 g of the blue vat dye of C.I. No. 60015 (Vat Blue 26), 30 ml of 38° Bé NaOH and 3 g of hydroxyacetone. The result obtained is a level, rub- and wash-fast blue dyeing which is about 50% weaker than that obtained in Example 3.

Example 4

A bleached cotton tricot is dyed in a laboratory beaker bath in a liquor ratio of 20:1 with a liquor containing per liter 0.5 g of the vat dye of C.I. No. 69525 (Vat Black 25), 30 ml of 38° Bé NaOH and 3 g of α-hydroxycyclopentanone. The dyeing vessel is introduced into the bath at 25° C. and heated over 15 min to 60° C. The material is then dyed at 60° C. for 30 min and the dyeing is subsequently finished in a conventional manner by oxidizing, rinsing and soaping. The result obtained is a level, rub- and wash-fast olive dyeing. Its depth of shade corresponds to that of a comparative dyeing obtained with a dyeing liquor containing per liter 18 ml of 38° Bé NaOH and 6 g of sodium dithionite.

Comparative Example 4

Example 4 is repeated with the α-hydroxycyclopentanone replaced by hydroxyacetone. This gives a level rub- and wash-fast olive dyeing which is about 25% weaker than that obtained in Example 4.

Example 5

Bleached cotton twill is impregnated at room temperature to a wet pickup of 70% with a liquor containing per liter 60 g of the green vat dye of C.I. No. 59825 (Vat Green 01), 2 g of a wetting agent (mixture of mono-, di- and triphosphoric esters of 2-ethylhexanol) and 10 g of an antimigrant (polyacrylamide) and dried at 130° C. for 10 min. Thereafter the textile material is impregnated at room temperature to 100% of its weight with a liquor containing per liter 30 g of α-hydroxycyclopentanone and 100 ml of 38° Bé NaOH and then treated at 102° C. in a steamer for 1 minute. This is followed by rinsing with cold water, oxidizing with 3 ml/l of hydrogen peroxide for 3 min, rinsing and soaping at 98° C. for 5 min. The result is a level, rub- and wash-fast green dyeing. Its depth of shade corresponds to that of a comparative dyeing by the customary continuous process with a liquor containing per liter 100 ml of 38° Bé NaOH and 60 g of sodium dithionite.

Comparative Example 5

Example 5 is repeated with the α-hydroxycyclopentanone in the reducing agent liquor replaced by hydroxyacetone. The result obtained is a level, rub- and wash-fast green dyeing which is about 25% weaker than that obtained in Example 5.

Example 6

Bleached cotton twill is impregnated at room temperature to a wet pickup of 70% with a liquor containing per liter 60 g of the blue vat dye of C.I. No. 69800 (Vat Blue 04), 2 g of a wetting agent (mixture of mono-, di- and triphosphoric esters of 2-ethylhexanol) and 10 g of an antimigrant (polyacrylamide) and dried at 130° C. for 2.5 min. Thereafter the textile material is impregnated at room temperature to 100% of its weight with a liquor containing per liter 30 g of α-hydroxycyclopentanone and 100 ml of 38° Bé NaOH and treated at 102° C. in a steamer for 1 min. This is followed by rinsing with cold water, oxidizing with 3 ml/l of hydrogen peroxide for 3 min, rinsing and soaping at 98° C. for 5 min. The result is a level, rub- and wash-fast blue dyeing. Its depth of shade corresponds to that of a comparative dyeing in which the reduction of the vat dye is carried out with a liquor containing per liter 100 ml of 38° Bé NaOH and 60 g of sodium dithionite.

Comparative Example 6

Example 6 is repeated with the α-hydroxycyclopentanone in the chemical liquor replaced by hydroxyacetone. The result obtained is a level, rub- and wash-fast blue dyeing which is about 30% weaker than that obtained in Example 6.

We claim:

1. A process for dyeing and printing textile materials consisting of cellulose fibers or containing cellulose fibers in a blend with other fibers in an aqueous medium at above pH 12 with vattable dyes in the presence of at least one reducing agent for the vattable dyes and finishing the dyeing in a conventional manner, which comprises using reducing agents that are aliphatically saturated cyclic compounds which contain at least one instance of the structural unit

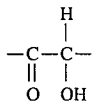

(I)

in the ring of the molecule.

2. A process as claimed in claim 1, wherein the cyclic compounds are used in amounts of from 1 to 10 g/l of liquor.

3. A process as claimed in claim 1 or 2, wherein the reducing agent used is α-hydroxycyclohexanone.

4. A process as claimed in claim 1 or 2, wherein the reducing agent used is α-hydroxycyclopentanone.

5. A process as claimed in claim 1, wherein the cyclic compounds are of the formulae (II), (IV), (V), (VI), (VII), (VIII), (X), (XI), (XII), (XIII), (XIV) or (XV):

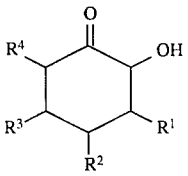

(II)

where the substituents $R^1$, $R^2$, $R^3$ and $R^4$ are independently of one another H, $C_1$–$C_4$-alkyl, OH, $OCH_3$ or phenyl,

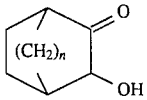

(IV)

where n is 1 or 2,

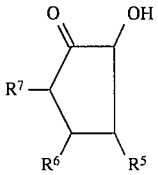

(V)

where the substituents $R^5$, $R^6$ and $R^7$ are independently of one another H, $C_1$–$C_4$-alkyl, OH, $OCH_3$ or phenyl,

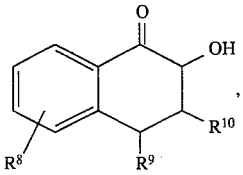

(VI)

where the substituents $R^8$, $R^9$ and $R^{10}$ are independently of one another H, $C_1$–$C_4$-alkyl, OH or $OCH_3$,

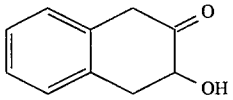

(VII)

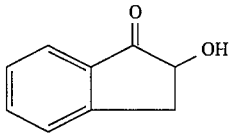

(VIII)

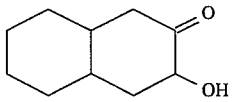

(X)

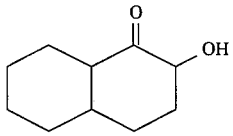

(XI)

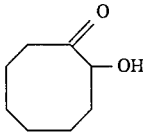

(XII)

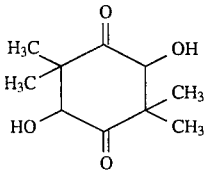

XIII

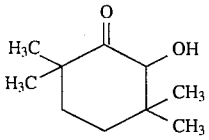

XIV

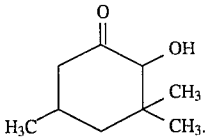

XV

6. A process for dyeing and printing textile materials consisting of cellulose fibers or containing cellulose fibers in a blend with other fibers in an aqueous medium at above pH 12 with vattable dyes in the presence of at least one reducing agent for the vattable dyes and finishing the dyeing in a conventional manner, which comprises using reducing agents that are cyclic compounds of the formulae (IIIa), (IIIb), (IIIc) or (IX):

(IIIa)
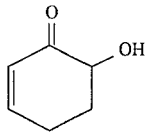
(IIIb)
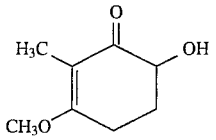
(IIIc)
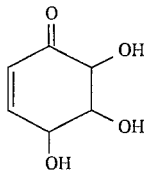
-continued
(IX)
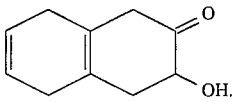
7. A process as claimed in any of claims 1, 2, 5 or 6, wherein the dyeing is carried out in the additional presence of quinonoid compounds which are water-soluble under the dyeing conditions.
* * * * *